US008322548B2

(12) United States Patent
Pedersen

(10) Patent No.: US 8,322,548 B2
(45) Date of Patent: Dec. 4, 2012

(54) PACKAGING

(75) Inventor: Lars Pedersen, Niva (DK)

(73) Assignee: Knudsen Plast A/S, Frederiksvaerk (DK)

( * ) Notice: Subject to any disclaimer, the term of this patent is extended or adjusted under 35 U.S.C. 154(b) by 345 days.

(21) Appl. No.: 12/437,059

(22) Filed: May 7, 2009

(65) Prior Publication Data

US 2009/0277863 A1 Nov. 12, 2009

(30) Foreign Application Priority Data

May 8, 2008 (EP) ..... 08155887

(51) Int. Cl.
*B65D 51/24* (2006.01)

(52) U.S. Cl. ..... 215/302; 215/330; 215/301; 215/329; 215/218; 215/223

(58) Field of Classification Search ..... 215/329, 215/330, 218, 217, 223, 301, 302, 359
See application file for complete search history.

(56) References Cited

U.S. PATENT DOCUMENTS

| | | | | | |
|---|---|---|---|---|---|
| 629,982 | A * | 8/1899 | Brant | 215/302 |
| 1,912,969 | A * | 6/1933 | Carvalho | 215/302 |
| 1,932,147 | A * | 10/1933 | Sabatine | 215/302 |
| 2,018,006 | A * | 10/1935 | Barnby | 215/337 |
| 2,067,117 | A * | 1/1937 | Carhart | 215/233 |
| 2,094,567 | A * | 9/1937 | Barnby | 215/302 |
| 2,408,233 | A * | 9/1946 | Smith | 220/284 |
| 2,921,705 | A * | 1/1960 | Dorsey | 215/215 |
| 3,164,277 | A * | 1/1965 | Reading | 215/215 |
| 3,501,041 | A * | 3/1970 | Schaefer | 215/215 |
| 3,716,161 | A * | 2/1973 | Julian et al. | 215/330 |
| 3,722,727 | A * | 3/1973 | Gach | 215/220 |
| 3,830,390 | A * | 8/1974 | Gach | 215/220 |
| 3,843,008 | A * | 10/1974 | Colella | 215/215 |
| 4,014,449 | A * | 3/1977 | Hadley et al. | 215/215 |
| 4,156,491 | A * | 5/1979 | Lyon | 215/302 |
| 4,320,844 | A * | 3/1982 | Cooper | 215/260 |
| 4,413,742 | A * | 11/1983 | Sandhaus | 215/216 |
| 4,731,512 | A * | 3/1988 | Barriac | 215/220 |
| 5,147,052 | A * | 9/1992 | Minette | 215/215 |
| 5,704,502 | A * | 1/1998 | Greenfield | 215/295 |
| 5,791,505 | A * | 8/1998 | Gilliland | 215/228 |
| 6,029,834 | A * | 2/2000 | Sanner | 215/215 |
| 6,112,920 | A * | 9/2000 | Lahaussois | 215/213 |
| 6,612,450 | B1 * | 9/2003 | Buono | 215/228 |
| 6,679,395 | B1 * | 1/2004 | Pfefferkorn et al. | 215/307 |
| 7,510,094 | B1 * | 3/2009 | Willis et al. | 215/218 |
| 7,832,578 | B1 * | 11/2010 | Willis et al. | 215/222 |
| 2007/0045219 | A1 * | 3/2007 | Nasiatka | 215/302 |
| 2008/0251491 | A1 * | 10/2008 | Krautkramer | 215/341 |

* cited by examiner

*Primary Examiner* — Anthony Stashick
*Assistant Examiner* — Christopher McKinley
(74) *Attorney, Agent, or Firm* — Fish & Richardson P.C.

(57) ABSTRACT

A packaging including a container body and a closure wherein the closure comprises upstanding wall portions on the upper face defining a receiving area for e.g. a pen. The packaging having first and second engagement means engaging each other for locking said closure to said container body. The closure further comprises release means for disengaging the first engagement means from the second engagement means wherein the release means being arranged such that a depressable portion thereof protrudes into a groove or receiving area. The release means being operable to disengage first engagement means from the second engagement means an elongated object being received by the receiving area or groove.

9 Claims, 2 Drawing Sheets

PACKAGING

The present invention relates to a packaging including a container body and a closure. The packaging is adapted to be effortless operated while at the same time the packaging is also being child or tamper proof.

According to one aspect the invention relates to packaging including a container body and a closure wherein the closure has an upper face, a peripheral face and upstanding wall portions on the upper face defining a receiving area for an elongated object. The packaging having first and second engagement means engaging each other for locking the closure to the container body.

The closure further comprises release means for disengaging the first engagement means from the second engagement means wherein said release means being arranged such that a depressable portion thereof protrudes into the receiving area. The release means being operable to disengage the first engagement means from the second engagement means upon the elongated object being received by the receiving area.

BACKGROUND

Packagings comprising tamperproof or childproof closures e.g. containing medicine and the like are well known. It is equally known to provide packagings provided with different means assisting elderly, disabled or weak persons in opening the packing.

It is also common to provide packagings which are both childproof or tamperproof while at the same the packagings are adapted to assist elderly, disabled or weak persons in opening the packaging.

Below publications teach such packagings:

U.S. Pat. No. 5,147,052 A teach a two-piece child resistant closure build up from an inner cap and an outer cap. The inner cap has projections on the top which are accessible through the open center of the outer cap to assist the user in opening the container. This provides a user friendly closure for the elderly and arthritically impaired people while still maintaining the usual child resistant opening feature, which may, for example, require a simultaneous push and turn movement.

U.S. Pat. No. 6,029,834 A teach a childproof and tamperproof closure for a container having an outer cap which can be twisted relative to an inner cap and further, the caps can be shifted axially. Coupling projections on each of the caps can be brought into and out of engagement by the axial displacement of the outer cap with respect to the inner cap. Break-off elements include a breakout projection protruding from the inner cap in a direction away from the container and towards the outer cap.

BRIEF DESCRIPTION OF THE INVENTION

It is an object of the present invention to present a packaging including a container body and a closure which is adapted to be effortless operated by weak, elderly or disabled people while at the same time the packaging is also child or tamper proof.

According to the invention, a packaging including a container body and a closure comprising release means for disengaging first engagement means, which may be arranged within the closure, from the second engagement means, which may be arranged on the container body is disclosed.

The release means being arranged such that a portion thereof depressable protrudes into the receiving area formed in the upper face of the closure. The release means being operable to disengage the first engagement means from the second engagement means upon an elongated object being received by the receiving area.

The elongated object, which e.g. could be a pen, a knitting pin or the handle of a knife etc. is placed in the receiving area of the closure such that the ends of the object protrudes beyond the peripheral face of the closure. The receiving area is arranged such that when a user to applies a twisting force to the object, the object will remain in the receiving area and transfer the applied force and torque to the closure resulting in an elderly, disabled or weak person being able to apply a significantly higher opening or closing torque to the closure.

The increased opening torque is especially desirable when the packaging is arranged with means indicating whether the packaging has been opened, e.g. prior to the costumers purchase. Such means could constitute tamper indicating means extending around the body and arranged such that upon the packaging being opened for the first time, break-off regions breaks and a major portion of the indicating means is released from said closure.

The receiving area can take any suitable form accommodating receipt of the elongated object. One preferred for form is a groove extending in the upper face of the closure.

Upon the elongated object being received by the receiving area and pressure is applied to the object, the object depresses the protruding release means, and the release means are preferably held in the depressed state as long as the elongated object is present in the receiving area.

Upon the user removing the desired content stored in the packaging, the closure may again be mounted on the container body, possibly by means of an elongated body being placed in the receiving area of the closure. The engagement means is preferable arranged such that upon the closure approaching its closed position, the engagement means automatically locks the closure to the container body.

DETAILED DESCRIPTION OF THE INVENTION WITH REFERENCE TO THE FIGURES

Figure 1:
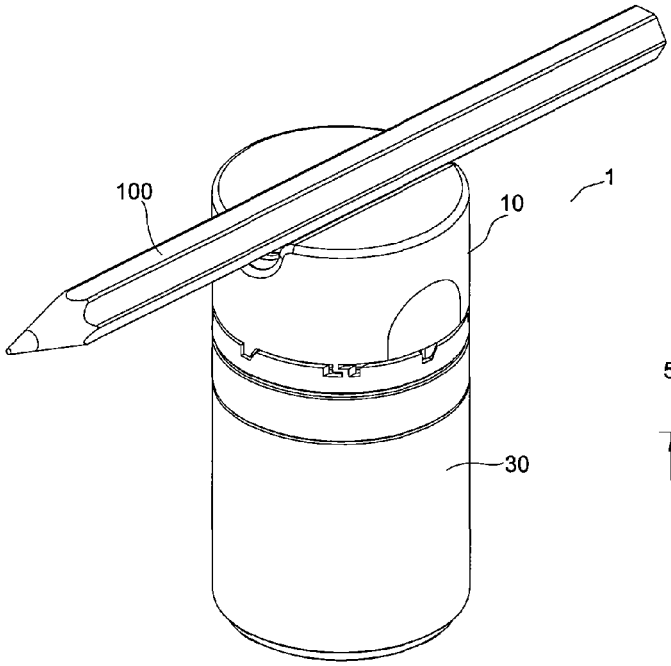
FIG. 1 shows a perspective view of a packaging according to the present invention.

FIG. 1 shows a perspective view of packaging wherein a closure 10 is mounted on a container body 30, and wherein an elongated object 100, in this case a pencil, is received by a groove in the closure 10.

The drawings shows the packaging 1 in an unopened state corresponding to the state in which a consumer expects to receive the packaging directly after its purchase. As can be seen in FIG. 1, the closure 10 comprises a groove 11 formed in the upper surface 12 of the closure 10 and defining recesses in the peripheral face 13 of the closure 10.

The groove 11 is depicted as an essentially continuous and parallel arc-shaped depression, however the groove 11 may equally be formed with partially straight sides resulting in a groove which may take any edged form, and further the groove is not necessarily formed as a continuous groove extending uninterrupted between two opposed peripheral sides of the closure 10, meaning that depressions, recesses or hollows etc. may be arranged within the groove 11. Although the closure 10 according to the figures are provided with a groove, this is for illustrative purposes only, as the upper face 12 of the closure 10 equally may be provided with upstanding wall portion defining a receiving area 11 adapted to receive an elongated object 100.

The groove or receiving area 11 may define opposite recesses in said peripheral face 13.

Release means 50 are arranged within the groove or receiving area 11 and are arranged such that the release means 50 are forced towards the bottom of the groove or receiving area 11 upon an elongated object 100 being received by the groove or receiving area 11. It is preferred that the release means 50 extends only within the groove or receiving area 11, however the release means 50 may to a certain extend also extend beyond the groove or receiving area 11 and intersect a plane defined by the upper surface 12 of the closure 10.

The closure 10 may be provided with tamper indicating means 16, e.g. in the form of a ring moulded together with said closure 10 and extending around said body 30 and arranged such that upon the packaging 1 being opened for the first time, break-off regions 15 breaks and a major portion of said indicating means 16 is released from said closure 10.

Figure 2:
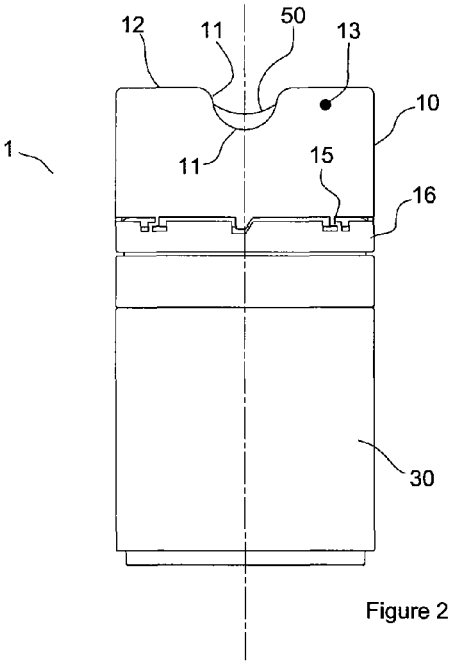
FIG. 2 shows a side view of the packaging of FIG. 1.

Further, FIG. 2 shows the container body 30 having an upper portion covered by the closure 10.

Figure 3:
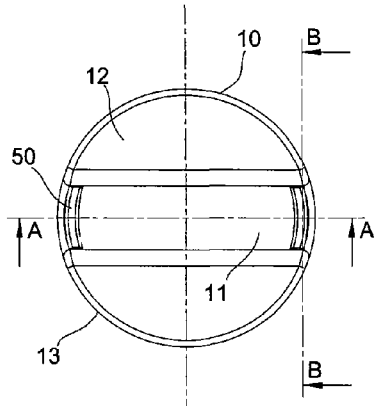
FIG. 3 shows a top view of the packaging of FIG. 1.

FIG. 3 is a view facing the upper surface 12 of the closure 10. The figure shows two release means 50 arranged within the groove 11 and in the vicinity of the peripheral face 13 of the closure 10.

Figure 4:
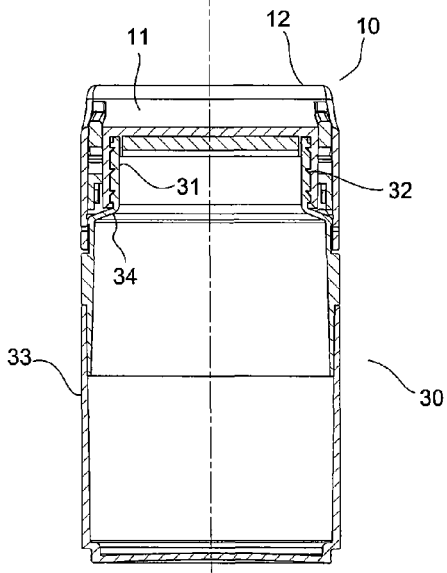
FIG. 4 shows a sectional view of a detail of the packaging of FIG. 1.

FIG. 4 is a sectional view of the packaging 1 through the line A-A shown on FIG. 3, i.e. a vertical section through the centre of the groove 11, wherein the closure 10 is fitted to the container body 30.

The container body 30 has a diameter which, at an end facing the closure 10 and on a substantially parallel portion 31 comprising threads 32, is reduced such that the neck of the container body 30 defines a cylindrical portion which is smaller than the peripheral wall 33 of the container body 30. A shoulder portion 34 connects the portion 31 with the peripheral wall 33 of the container body 30.

Figure 5:
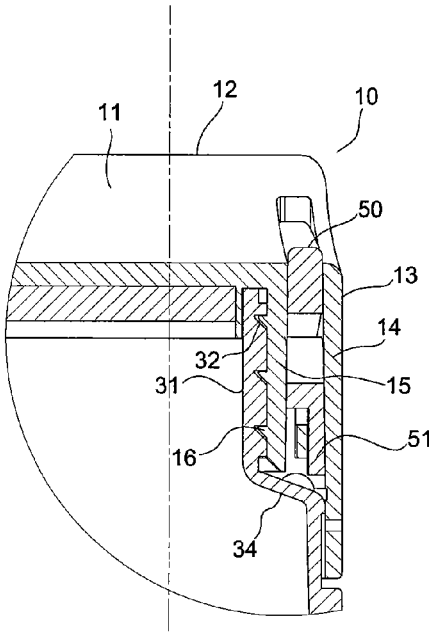
FIG. 5 shows an enlarged sectional view of a detail of the packaging of FIG. 1.

FIG. 5 is an enlarged sectional view of a portion of the packaging 1, of the area where the container body 30 receives the closure 10, and according to FIG. 4. As shown on the figure, the closure 10 is arranged with an outer wall 14, oriented substantially perpendicular to the upper surface 12, and the wall 14 is, via its outer face, defining the peripheral face 13 of the closure 1. Further the closure 10 comprises an inner wall 15, arranged substantially perpendicular to the upper surface 12, and is on its internal side provided with threads 16 being able to engage with the threads 32 arranged on the upper portion of the container body 30.

Further, the enlarged view of FIG. 5 shows a sectional view through the release means 50 being in a depressed state, that is e.g. when an elongated object (not shown in FIG. 5) is received by the groove 11 and pressed downwards against the bottom of the groove 11.

Figure 6:
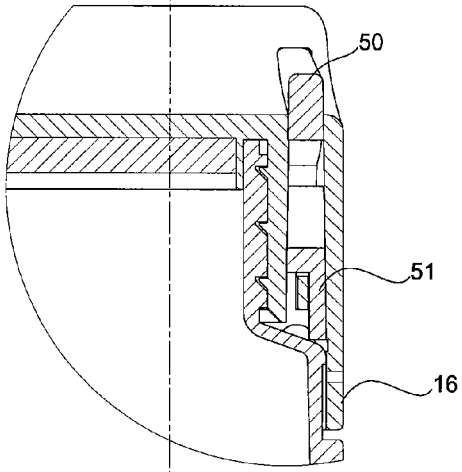
FIG. 6 shows an enlarged sectional view of a detail of the packaging of FIG. 1.

FIG. 6 shows a view according to FIG. 5, however wherein the release means 50 being free. Second engagement means 51 is shown resting in a position wherein the engagement means or pawls 51 rests in a position wherein the closure 10 is prevented from being removed from container body 30 by unscrewing the closure 10.

Figure 7:
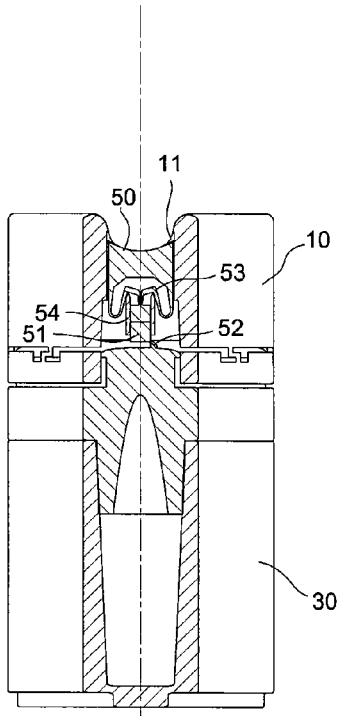
FIG. 7 shows a sectional view of the packaging of FIG. 1.

FIG. 7 is a sectional view of the packaging 1 through the line B-B shown on FIG. 3, i.e. a vertical section through the engagement means etc., wherein the closure 10 is fitted to the container body 30, and wherein the release means 50 is depressed against the bottom of the groove 11 of the closure 10.

The release means 50 releases the second engagement means 51 constituting e.g. one or more pawls, from engagement with the first engagement means 52, constituting e.g. one or more protrusions, arranged the portion 34 of the container body 30.

Upon a elongated object being received by the groove 11, and the object is pressed against the bottom of the groove 11, the release means is forced downwards into the closure 10 wherein a secondary part 53 of the release means 50 meets a backing 54 which directs an opposed force into the secondary part 53 of the release means 50, and the second engagement means 51 are forced upwards towards the upper face 12 of the closure 10.

Figure 8:
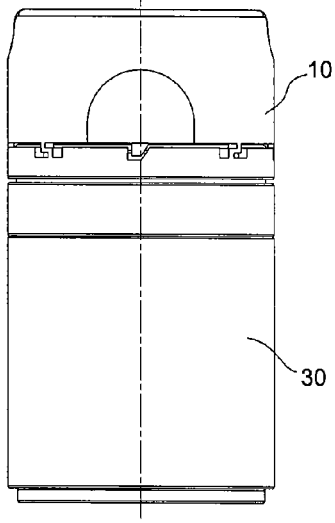
FIG. 8 shows a side view of the packaging of FIG. 1.

FIG. 8 shows a view according to FIG. 2, however from an angle being perpendicular to the view of FIG. 2.

The invention claimed is:

1. A packaging including a container body and a closure, said closure having an upper face, a peripheral face and a groove on said upper face extending between two opposed sides of the closure and defining a receiving area for an elongated object, said groove having ends that define opposite recess in said peripheral face, and said packaging having first and second engagement means engaging each other for locking said closure to said container body, and release means for disengaging said first engagement means from said second engagement means, said release means being arranged such that a depressible portion thereof protrudes into said receiving area, and is forced into the closure upon receipt of an elongated object by the receiving area to disengage said first engagement means from said second engagement means upon said elongated object being received by said receiving area.

2. A packaging according to claim 1 wherein said receiving area constitutes at least one groove.

3. A packaging according to claim 1, said engagement means also being disengageable upon applying pressure to said peripheral face.

4. A packaging according to claim 1 wherein said closure is internally threaded.

5. A packaging according to claim 1, wherein a pair of release means is arranged near said peripheral face.

6. A packaging according to claim 1 wherein said first engagement means automatically engages said second engagement means upon said closure being mounted to said container.

7. A packaging according to claim 1 wherein said closure is provided with tamper indicating means comprising a ring, molded to said closure and extending around said body, arranged such that upon the packaging being opened for the first time, break-off regions break and a major portion of said indicating means is released from said closure.

8. A packaging according to claim 1 wherein said elongated object acts as a lever increasing users applied opening torque.

9. A packaging according to claim 1 wherein said second engagement means is forced upwards towards the upper face of the closure upon a elongated object being received in said groove.

* * * * *